United States Patent [19]

Schwuchow

[11] 4,322,004

[45] Mar. 30, 1982

[54] SNOWMAN HAT-KIT

[76] Inventor: Brian P. Schwuchow, 2110 W. 3rd. St., Hobart, Ind. 46342

[21] Appl. No.: 208,550

[22] Filed: Nov. 20, 1980

[51] Int. Cl.[3] ..... A63H 3/00; A63H 33/00; B65D 69/00

[52] U.S. Cl. ..... 206/575; 206/579; 46/11; 46/22

[58] Field of Search ..... 206/575, 577, 579, 523, 206/216; 46/11, 12

[56] References Cited

U.S. PATENT DOCUMENTS 3,660,926 5/1972 Lerner et al. ..... 46/11

3,837,111 9/1974 Godfrey et al. ..... 206/579

*Primary Examiner*—William T. Dixson, Jr.

*Attorney, Agent, or Firm*—Walter Leuca

[57] ABSTRACT

This invention is a snowman hat-kit. It comprises a container shaped in the form of a hat which is used to adorn the snowman. The hat is structured to also serve as a container to store a plurality of pieces which are used to form the eyes, nose, mouth components, and like pieces such as buttons and pipe for adorning the snowman. These articles are thereby readily available from season to season.

10 Claims, 8 Drawing Figures

SNOWMAN HAT-KIT

BACKGROUND OF THE INVENTION

1. Field of the Invention

This invention relates generally to a collection of parts useful to embellish a snowman and more particularly to a container for the parts which is itself adapted to be useful to embellish a snowman.

2. Description of the Prior Art

The prior art problem that this invention is directed to is that of embellishing a snowman. It is traditional to embellish a snowman by providing eyes, nose, mouth and buttons by embedding stone-like pieces in the snowman's head and body at appropriate places. Traditionally, these stone-like pieces were pieces of coal which were generally more available and provided color contrast that was suitable. Variations were made in that a carrot or a small stick or such similar objects were provided instead of coal pieces for the snowman's nose. Also, a pipe embedded in the mouth area was added as well as a hat on top of the snowman's head to further characterize the snowman.

These items were never readily available and had to be searched for each time a snowman was made. With the exception of the hat and pipe, these items were lost or discarded when the snowman was destroyed or melted, and had to be searched for anew when another snowman was made at a different time.

SUMMARY OF THE INVENTION

My invention avoids the above disadvantages. By providing a novel container in the form of a hat which is adapted to anchor to the head of the snowman, the items or objects from which the eyes, nose, mouth, buttons and pipe are fashioned may be retained and stored when not in use during or between the winter seasons. Since these items can be saved, they may be uniformly made for their particular use and especially structured to be more securely anchored into the snow from which the snowman is made.

Other objects and advantages will become more apparent from a study of the following description which is to be read with reference to the accompanying drawings a preferred embodiment of my invention is illustrated.

DETAILED DESCRIPTION OF THIS INVENTION

Figure 5:
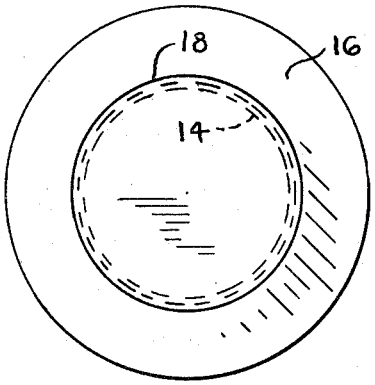
FIG. 5 is a top view thereof.
Figure 6:
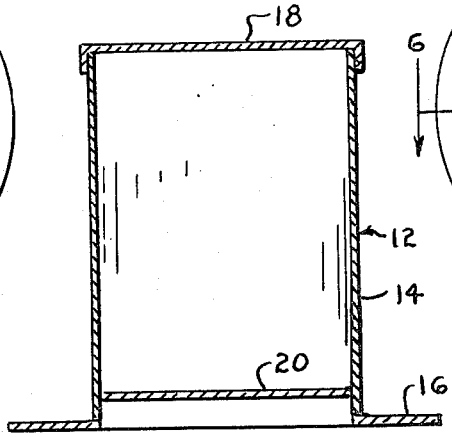
FIG. 6 is a longitundinal section of the hat container taken along line 6—6 of FIG. 4.
Figure 4:
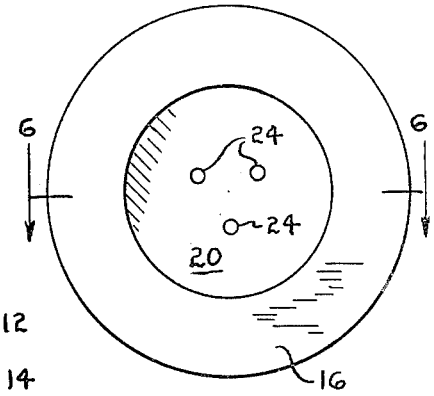
FIG. 4 is a bottom view thereof.
Figure 1:
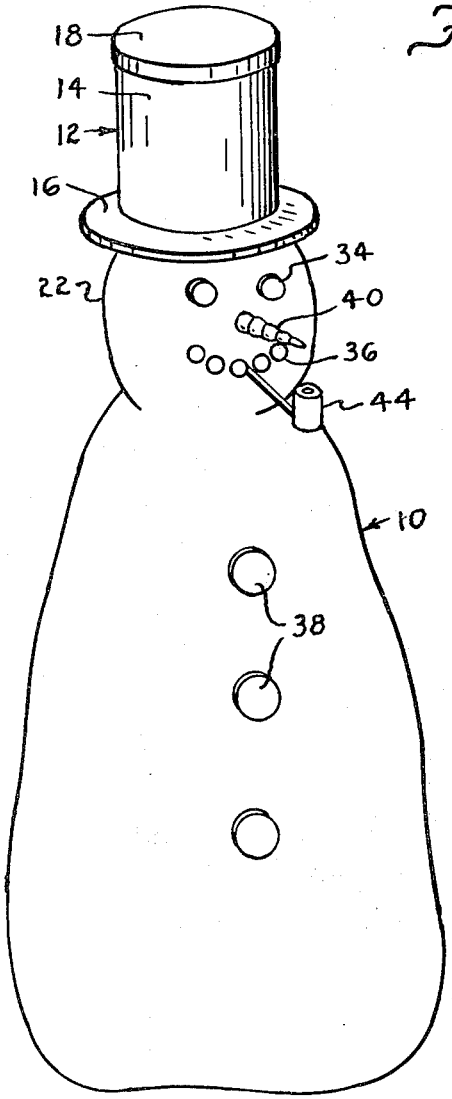
FIG. 1 is a pictorial view of a snowman shown embellished with the articles of my invention, the view of the hat container thereof is a top perspective.
Figure 3:
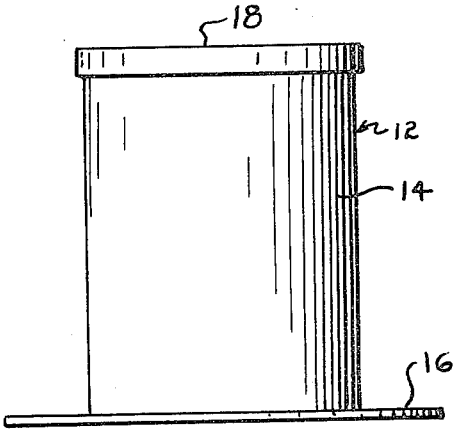
FIG. 3 is a side elevation of the hat container.
Figure 2:
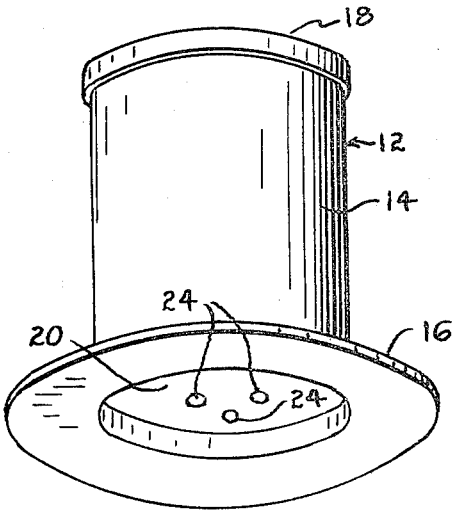
FIG. 2 is a bottom perspective view of the hat container of this invention.
Figure 8:
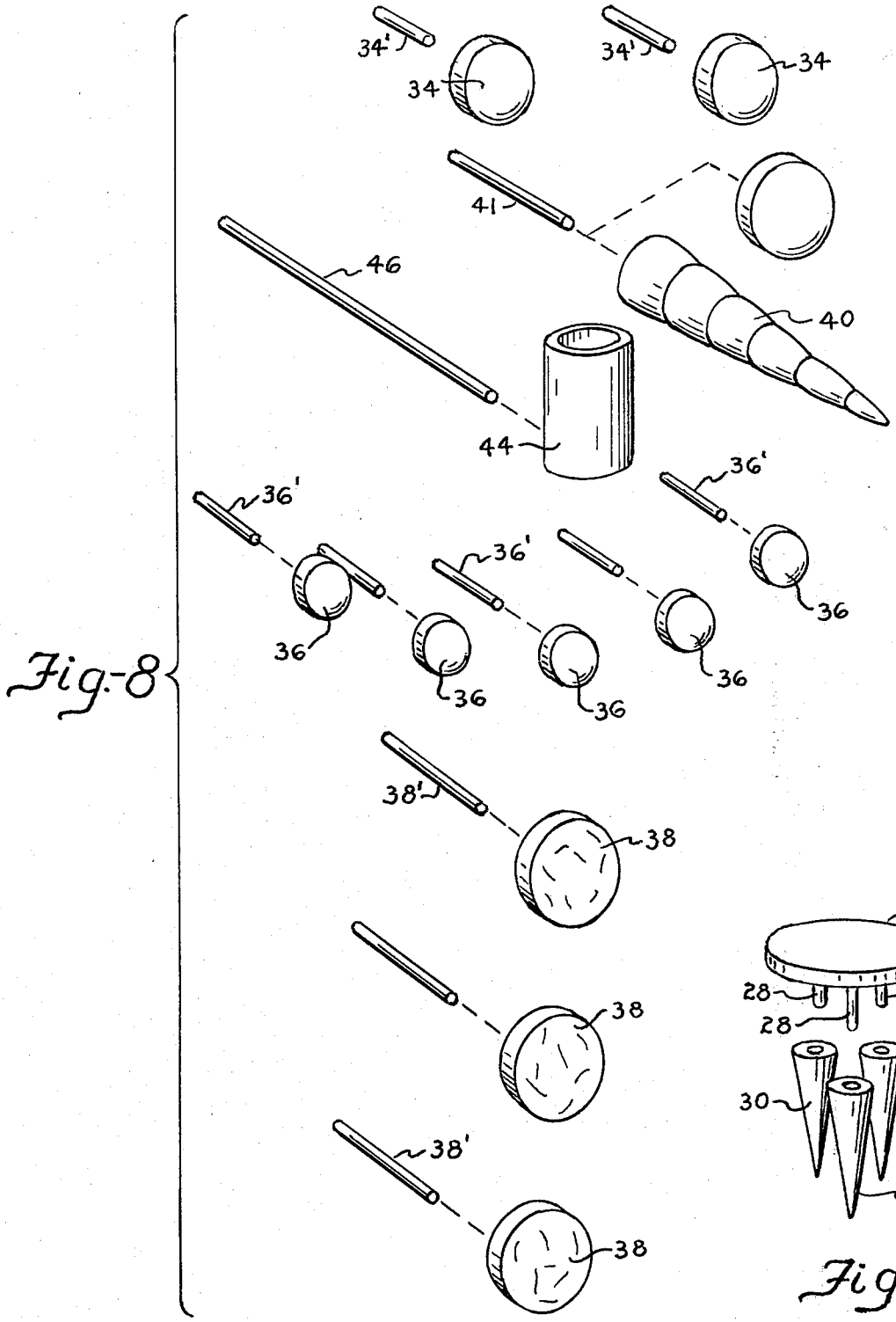
FIG. 8 is a collective array of pieces together with their anchoring stems shown in exploded relation thereto, which are used to construct and embellish the snowman with eyes, nose, mouth, buttons and pipe.

Referring now more particularly to the drawings, reference numeral 10 designates generally the snowman which is embellished with the pieces or items of my invention to provide the snowman form with amusing human characteristics and personality.

This invention comprises a hat container 12 formed, for example, with a cylindrical crown or body 14 having a circumferential brim 16 circumscribing one end, that is the bottom end of cylindrical body 14. The other end, which is top end, is provided with a removable tip or lid 18. Cylindrical body 14 is provided with a closure 20 spaced inwardly from the bottom end of the cylindrical body 14 so that the top portion of the snowman's head 22 may extend into the recessed part provided by the spaced closure 20 to obtain a more secure seat and give a more natural appearance. Closure 20 is provided with small openings 24 grouped in the central area thereof.

Figure 7:
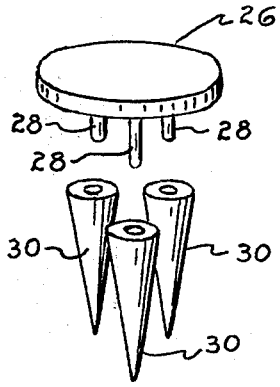
FIG. 7 the perspective view of the fastening members for anchoring the hat container to the head of the snowman shown in exploded relation.

With particular reference to FIG. 7, the hat container 12 anchor means include fastening elements comprising disk or plate member 26. Extending from one side of disk 26 are a plurality of stems 28, each thereof aligned with one of holes 24 provided in closure 20 so that upon assembly, disk member 26 may be placed on the inside of closure 20 with stems 28 protruding through holes 24. Stems 28 are then fitted with tapered dowels 30. Dowels 30 are provided with holes 32 to tightly receive stems 28 thereby clamping the fastening elements onto closure 20. Tapered dowels 30 form the anchors which are embedded in the snowman's head 22 in order to secure the hat container 12 to the snowman. The individual pieces 34, 36 and 38, shaped to form the eyes, mouth and buttons respectively, are provided with holes in the back side of each of the pieces for inserting therein dowel pegs 34', 36' and 38' which serve as anchors for pieces 34, 36 and 38 respectively, when embedded in the snowman at the appropriate places.

I provide carrot-shaped nose 40 and for variation I also provide a different shaped nose such as a cylindrical piece 42. Each of the nose shapes are also provided with a hole recess in the backside thereof for inserting therein peg 41 which serves as their anchor when embedded into the head of the snowman. Also provided is pipe 44 and stem 46 therefor for added embellishment.

When the snowman no longer serves the purpose of amusement or is destroyed by melting or otherwise destroyed, the pieces are removed from the snowman and the pegs associated therewith are disassembled. The tip, or top lid, 18 of that 12 is removed and the disassembled pieces are placed within cylindrical body 14 of hat 12 for storage. Lid 18 is then replaced and hat container 12 is stored until it is desired to reuse them or until the next season. At this time all the pieces necessary to embellish a snowman with the traditional features of a human being such as eyes, nose, mouth, buttons and pipe will be readily available, including the hat. There will be no need to search for the proper pieces or provide makeshift items each season or each time a snowman is built.

It is understood that hat container 12 as heretofore described and shown in the drawings is a preferred embodiment. The hat container 12 of my invention can have a variety of shapes provided that the crown or body 14 of the hat is made with a large enough cavity to serve as a container and an end thereof is made removable so that access may be had to the cavity to deposit therein the articles to be stored or to be retrieved therefrom. Further, disk or plate member 26 may be substituted for closure 20 provided that pegs 28 do not extend beyond the recessed end of crown 14. Providing a closure 20 in the form of plate member 26 having fixed thereto pegs 28 to which dowel pieces 30 may or may not be connected in place of the combined parts described in the preferred embodiment, would be a matter of manufacturing expediency. Consequently, certain variations in details of structure could readily come to mind without departing from the spirit of the invention, the scope of which is more properly defined by the appended claims.

I claim:

1. A hat for a snowman comprising:

a crown having closures at both ends, one of said closures being removable from one of said ends of said crown, and the other of said closures being recessed in said crown spaced from the other end of said crown; and anchor means on said other closure extending in said recess provided at said other end of said crown.

2. The hat of claim 1 wherein said anchor means are further characterized as being a peg extending from said other closure.

3. The hat of claim 1 wherein said anchor means on said other closure are further characterized as including a member having a peg extending from said member, and said member being removably connected to said other closure by said peg extending through a hole in said other closure.

4. The hat of claim 3 wherein said peg extending through said hole in said other closure is further characterized as being connected to a dowel member to extend the length of said peg outside said recess.

5. The hat of claim 1 wherein said crown is further characterized as having a brim circumscribing the recessed end of said crown.

6. The hat of claim 1 wherein said crown is further characterized as having a cavity between said closure to contain a plurality of geometrical, discrete pieces shaped to represent the eyes, nose, and mouth components for a snowman.

7. The hat of claim 1 wherein said crown is further characterized as containing a plurality of geometrical, discrete pieces shaped to represent the eyes, nose, and mouth components for a snowman in said crown between said closures.

8. The combination of:

a hat for a snowman comprising a crown having closures at both ends, one of said closures being removable from one of said ends of said crown, and the other of said closures being recessed in said crown spaced from the other end of said crown, and said other closure being provided with anchor means; and a plurality of geometrical, discrete pieces shaped to represent the eyes, nose and mouth components for a snowman stored in said crown between said closures.

9. The combination of claim 8 wherein said anchor means is further characterized as including a member having a peg extending therefrom, said member being removably connected to one side of said other closure by said peg extending through a hole therein; a dowel member connected to said peg abutting against the other side of said other closure, said dowel member extending into said space provided by said other closure being recessed from said other end of said crown.

10. The combination of claim 9 wherein said anchor means are further characterized as being stored in said crown between said closures.

* * * * *